United States Patent [19]

Zowarka et al.

[11] Patent Number: 4,884,489

[45] Date of Patent: Dec. 5, 1989

[54] HIGH PERFORMANCE ELECTROMAGNETIC RAILGUN LAUNCHER

[75] Inventors: Raymond C. Zowarka; Damon A. Weeks; William F. Weldon; John H. Gully; Jim L. Upshaw; Mike L. Spann; Dennis R. Peterson, all of Austin, Tex.

[73] Assignee: Board of Regents University of Texas System, Austin, Tex.

[21] Appl. No.: 41,183

[22] Filed: Apr. 22, 1987

[51] Int. Cl.[4] ..... F41F 1/02

[52] U.S. Cl. ..... 89/8; 89/16

[58] Field of Search ..... 89/8, 15, 16

[56] References Cited

U.S. PATENT DOCUMENTS

| | | | |
|---|---|---|---|
| 294,350 | 3/1884 | Bartlett | 89/16 |
| 1,285,255 | 11/1918 | Levy | 89/16 |
| 3,126,789 | 3/1964 | Meyer | 89/8 |
| 4,200,831 | 4/1980 | Weldon et al. | 322/8 |
| 4,246,507 | 1/1981 | Weldon et al. | 310/242 |
| 4,423,662 | 1/1984 | McAllister | 89/8 |
| 4,437,383 | 3/1984 | Deis et al. | 89/8 |
| 4,459,504 | 7/1984 | Weldon et al. | 310/243 |
| 4,572,964 | 2/1986 | Honig | 307/106 |
| 4,608,908 | 9/1986 | Carlson et al. | 89/8 |
| 4,624,173 | 11/1986 | Creedon | 89/8 |
| 4,625,618 | 12/1986 | Howanick | 89/8 |
| 4,641,567 | 2/1987 | Creedon | 89/8 |

OTHER PUBLICATIONS

D. R. Peterson et al., "Testing of a High Performance, Precision Bore Railgun," 3rd Symposium Electromagnetic Launch Technology, Austin, Texas, Apr. 22, 1986.

Sims et al., "A Launcher Barrel for the Lethality Test System Railgun," Third Symposium on Electromagnetic Launch Technology, Apr. 22–24, 1986, Austin, Texas (reprinted in IEEE Transactions on Magnetics, vol. MAG-22, No. 6, Nov. 1986, pp. 1742–1745).

Davidson et al., "Predicting Bore Deformations and Launcher Stresses in Railguns," Third Symposium on Electromagnetic Launch Technology, Apr. 22–24, 1986, Austin, Texas.

Susoeff et al., "Generation of Round Bores in Composite Structure Railguns," Lawrence Livermore Laboratory (Mar. 7, 1985).

Spann et al., "A Rapid Fire, Compulsator–Driven Railgun System," Third Symposium on Electomagnetic Launch Technology, Austin, Texas, Apr. 20–24, 1986.

Peterson et al., "Design and Testing of High–Pressure Railguns and Projectiles," IEEE Transactions on Magnetics, vol. MAG–20, No. 2, (Mar. 1984).

S. Y. Wang, "The Structural Response of a Railgun Accelerator," NASA Technical Memorandum 83491, Second Symposium on Electromagnetic Launch Technology, IEEE, Boston, Massuchusetts, Oct. 10–14, 1983.

Hawke et al., "Results of Railgun Experiments Powered by Magnetic Flux Compression Generators," Lawrence Livermoore Laboratory (Mar. 1981).

(List continued on next page.)

*Primary Examiner*—Stephen C. Bentley

*Attorney, Agent, or Firm*—Arnold White & Durkee

[57] ABSTRACT

A railgun operates at high pressure (up to 350 MPa) without structural damage and is readily disassembled for inspection, maintenance and component testing. A rail assembly is pressed into a hoop-wound epoxy fiberglass containment tube and clamped within a steel compression frame. The geometry of the rail assembly permits rail movement without insulator intrusion and achieves bore sealing during rail movement at maximum pressure. The rail assembly also has replaceable insulator inserts which are isolated from rail re-bound shock. Fused quartz insulator inserts provide the best results. A flash tube is provided at the gun muzzle to suppress precursor discharge and commutate precursor current back to the armature. To realize increased velocity without sacrificing in-bore projectile stability, a cut-corner projectile is used having a L/D ratio as small as 0.65 which reduces the mass by about 11%.

9 Claims, 3 Drawing Sheets

OTHER PUBLICATIONS

Brooks et al., "Design and Fabrication of Large- and Small-Bore Railguns," Lawrence Livermoore Laboratory (Mar. 13, 1981).

R. A. Marshall, "Railgun Overview," Department of Energy Impact Fusion Workshop, Los Alamos Scientific Laboratory, Jul. 10–13, 1979.

R. S. Hawke, "Railgun Accelerators for Launching 0.1-g Payloads at Velocities Greater than 150 km/s," DOE Impact Workshop, Los Alamos Scientific Laboratory, Jul. 10–13, 1979.

Rashleigh and Marshall, "Electromagnetic Acceleration of Macroparticles to High Velocities," J. Appl. Phys. 49(4) (Apr. 1978), pp. 2540–2542.

FIG. 1
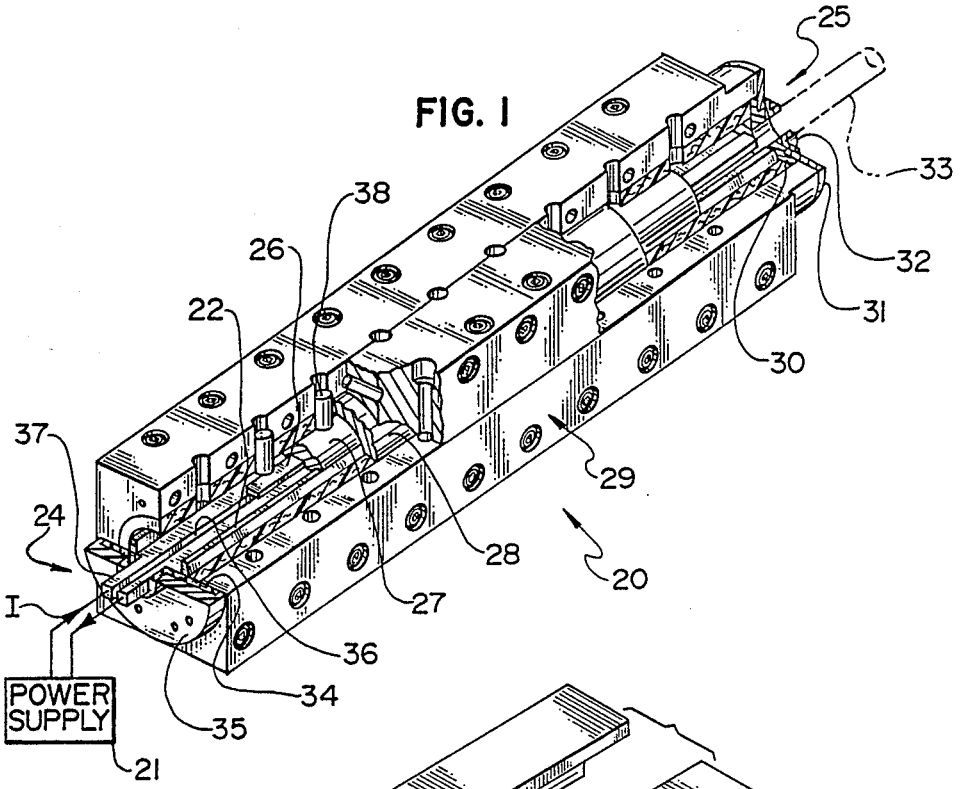
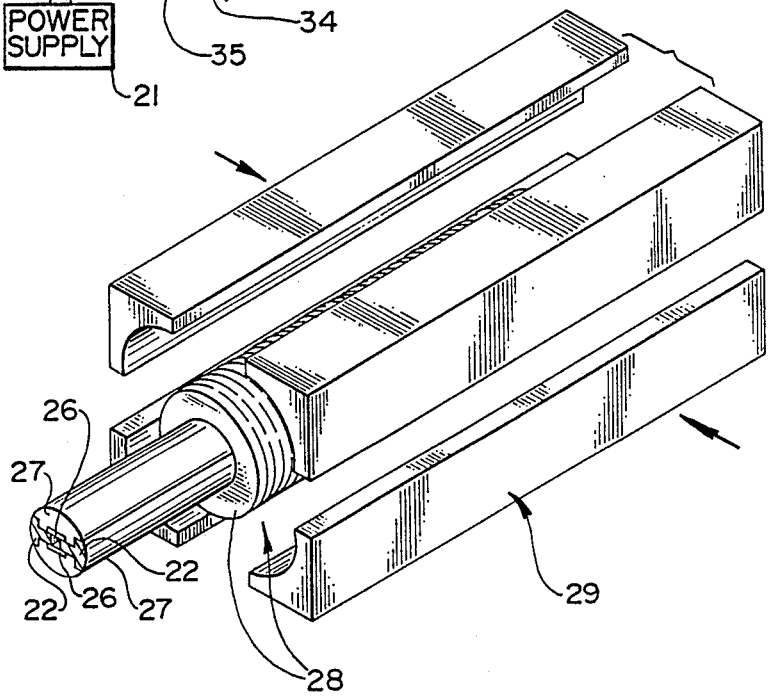
FIG. 2

HIGH PERFORMANCE ELECTROMAGNETIC RAILGUN LAUNCHER

The United States government may have rights in this invention pursuant to funding arrangements with the Department of Defense.

BACKGROUND OF THE INVENTION

1. Field of the Invention

This invention relates to improvements in electromagnetic railgun construction which substantially improve railgun performance and durability, and facilitate rebuilding between successive firings. In particular, the invention relates to a railgun having a containment structure for preloading bore seals, an internal geometry which prevents insulator intrusion into the bore and promotes sealing of the bore, a flash tube to commutate precursor current back into the gun breech, and a projectile geometry providing a higher velocity without sacrificing in-bore projectile stability.

2. Description of the Related Art

Thermodynamic guns are widely used and generally understood in a broad context. In an ordinary thermodynamic gun, a propellant burns to generate high pressure gas that pushes a projectile down a bore. While thermodynamic guns are used in many applications besides weapons—for example scientific and industrial applications—their use is somewhat limited because of the maximum velocities attainable. Thus, physical limitations limit the projectile from such thermodynamic guns from reaching velocities much greater than one kilometer per second.

Electromagnetic railguns have been widely investigated since World War II as an alternative to thermodynamic guns because of the possibilities of achieving projectile hypervelocities (greater than one kilometer per second). Hypervelocity guns and launchers are under development for a wide range of applications, including anti-missile systems for strategic defense, impact fusion for nuclear energy production, and launching systems for satellites and spacecraft.

The early electromagnetic railguns incorporated a solid armature which was propelled between the rails By the electromagnetic force generated by the current flow through the armature and the rails. However, it was soon found that at high speeds around one kilometer per second, the rails and armature were substantially damaged, possibly as a result of ohmic heating and/or internal forces. Further, increases in current flow tended to only increase rail and armature gouging without an increase in armature velocity. Thus, armature velocities in excess of one kilometer per second were not practically attainable for railguns using solid armatures.

In the early 1970's, R. A. Marshall, J. P. Barber, and others at the Australian National University, Canberra, Australia, developed railguns using plasma armatures which could obtain hypervelocities and could make efficient use of high current, pulsed power supplies, such as compulsators and homopolar generators. Plasma armature railguns are generally described in S. C. Rashleigh and R. A. Marshall, "Electromagnetic Acceleration of Macroparticles to High Velocities," 49 *J. App. Phys.* 2540 (Apr. 1978) (incorporated herein by reference). Such power supplies are broadly illustrated in U.S. Pat. Nos. 4,200,831; 4,459,504; 4,246,507; and U.S. patent application Ser. No. 067,410 filed June 24, 1987 (incorporated herein by reference).

In recent years, additional research has revealed numerous problems associated with very high current plasma armatures. For example, at the high currents necessary to obtain hypervelocities, rail erosion has been a significant problem which essentially relegates the railgun to a one or two shot application. Additionally, plasma armature type railguns require a sealed bore (open only at the muzzle) capable of withstanding the substantial electromagnetic forces generated; the gaskets, seals, and insulator material associated with such bores have proven a significant problem. For example, in addition to rail and insulator damage, metallic deposits often adhere to the insulator surfaces after firing, causing arcing problems during subsequent firing.

In addition to the practical difficulties of plasma-type electromagnetic railguns, several fundamental problems have become of increasing concern. For example, at the typical working currents in question, the dissipative armature voltage drop is an order of magnitude greater than desirable. Perhaps more fundamentally, plasma armatures are designed to accelerate a projectile using base pressures. Base pressure acceleration (such as also used in thermodynamic guns) places severe design limits on the projectile. For example, a projectile must be able to withstand the extreme temperature and pressures exerted at its base by the driving plasma.

At present, railgun performance is limited to a laboratory environment by the lengthy rebuild periods between successive firings and the inability of the bore materials to withstand the extreme forces during firing. Similar considerations dictate the feasibility and economy of railgun applications outside of the laboratory where the railgun will be operated under somewhat less stringent conditions. Therefore, it is desirable to provide a more durable railgun construction to increase the number of shots between rebuilding times and to facilitate the rebuilding process.

SUMMARY OF THE INVENTION

The primary object of the present invention is to provide a more durable electromagnetic railgun construction.

Another object of the invention is to provide an electromagnetic railgun construction that facilitates rebuilding between firings.

Yet another object of the invention is to provide a means for incorporating insulators of various kinds in the gun assembly about the bore.

A further object of the invention is to provide improved sealing between the insulators and rails in the gun assembly.

Still another object of the invention is to suppress the undesirable effect of the precursor discharge which occurs ahead of the projectile during firing.

Moreover, another object of the invention is to provide a projectile geometry which results in a higher velocity without sacrificing in-bore projectile stability.

Briefly, in accordance with the invention, these objects are met by providing a railgun launcher including a gun assembly, a containment structure, and a compression frame including a number of external clamping members. The gun assembly includes a pair of parallel current conducting rails, and a pair of sidewall supports carrying insulator inserts. During construction, the gun assembly is pressed into the containment tube, and the clamping members of the compression frame are secured and tightened together to provide a preload to activate bore seals in the gun assembly.

The internal railgun geometry permits rail movement without allowing insulator intrusion into the bore. Intrusion is undesirable since it may impede the path of the projectile and compromise the bore seal. During firing the magnetic pressure drives the rails apart, but due to the internal railgun geometry of the present invention, the insulators are forced into sealing contact with the rails as the rails move apart. Therefore, maximum seal pressure is developed when the magnetic pressure is a maximum during firing.

The internal railgun geometry insures that the rails are not mounted directly on the insulator which provides bore sealing, so that brittle insulators may be used. The rails are equipped with flanges which bear on resilient sidewalls instead of the brittle insulators. During firing the rails are driven apart by magnetic pressure. After firing the rails rebound to their original position and do not strike the brittle insulators because the rail flanges strike the resilient sidewalls. Insulators may be installed as inserts and are therefore not a critical part of the gun structure and are easy to replace and inexpensive to fabricate.

A flash tube may be used to keep the precursor arc from spreading as it leaves the open end of the gun and therefore prevents the precursor arc from attaching between the rails of the gun and the compression frame of the gun as the precursor arc exits the muzzle. If the precursor arc attaches to the compression frame, the rails of the gun are shorted together, spoiling the gun performance. The flash tube allows a high voltage to be developed as the precursor arc exits the gun. This high voltage commutates the precursor current back into the armature.

To realize increased projectile velocities without sacrificing in-bore stability, a cut-corner projectile provides a decrease of about eleven percent in the projectile's mass.

BRIEF DESCRIPTION OF THE DRAWINGS

Other objects and advantages of the invention will become apparent upon reading the following detailed description and upon reference to the drawings in which:

FIG. 1 is a perspective view, in partial section, of a 1 m long, 13 mm, square-bore railgun incorporating features of the present invention;

FIG. 2 is a schematic drawing illustrating the method of assembling the railgun of FIG. 1;

Figure 3:
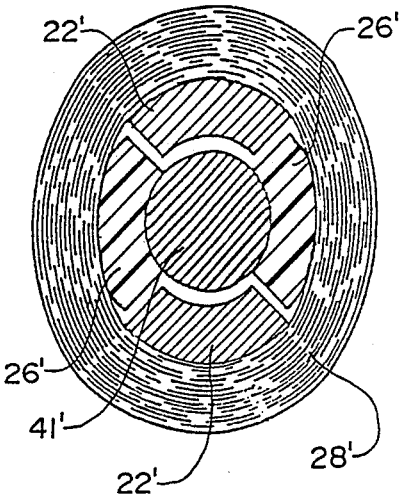
FIG. 3 PRIOR ART
FIG. 3, labeled "Prior Art, " is a schematic illustration of the apparent mechanism for bore-projectile interference in a cylindrical-bore railgun.

While the invention is susceptible to various modifications and alternative forms, a specific embodiment thereof has been shown by way of example in the drawings and will herein be described in detail. It should be understood, however, that it is not intended to limit the invention to the particular form disclosed, but on the contrary, the intention is to cover all modifications, equivalents, and alternatives falling within the spirit and scope of the invention as defined by the appended claims.

DESCRIPTION OF THE PREFERRED EMBODIMENT

Turning now to FIG. 1, there is shown an illustration of a 1 m long, 13 mm square-bore railgun generally designated (20) which incorporates various features of the present invention. Broadly speaking, the railgun (20) includes a power supply (21) feeding current (I) to a pair of rails (22). The rails are typically made of copper for good electrical conductivity, although refractory metal such as tantalum shows some promise in eliminating rail gouging or erosion. Between the rails there is disposed an armature means or projectile (23) so as to form a continuous circuit from the power supply (21). During firing of the projectile, the current (I) builds up to a relatively high level, thereby generating an intense magnetic field between the rails and behind the projectile. This magnetic field interacts with the current flowing through the armature means or projectile so as to accelerate the projectile and propel it from the breech (24) to the muzzle (25) of the gun (20).

In order to supply a high level of current to the rails (22), the power supply (21) is preferably a homopolar generator, it being understood that other types of energy stores may be appropriate in certain applications, for example, a compulsator or various types of capacitor-based distributed energy store systems. A specific type of homopolar generator useful as a power supply (21) is described in U.S. Pat. No. 4,459,504, which is incorporated herein by reference. For use with the railgun (20) as shown in FIG. 1 and further described below, the power supply should be capable of generating at least 500 kiloamps, which results in high pressure (up to 350 MPa) in the bore of the gun.

The railgun (20) is designed both to be capable of high-pressure operation without structural damage and to be readily disassembled for inspection, maintenance and component testing. Also, techniques have been developed to produce and measure smooth, extremely precise bores having a variation of less than 5 $\mu$m. It is believed that a high-precision bore dramatically enhances performance. Very high accelerations have been achieved in excess of about $10^7$ m/s$^2$, and a 2-g projectile has been accelerated to 5 km/s. These projectiles have been small polycarbonate blocks, as further shown in FIG. 12, and are propelled by a plasma armature. The gun (20), however, could be adapted for propelling solid armature projectiles. For this purpose, the rails are preferably provided with a layer of low conductivity material such as graphite along the interface with the armature, and the low-conductivity layers are preferably tapered so as to increase in thickness from the breech to the muzzle, as disclosed in Weldon, U.S. application Ser. No. 203,556 filed June 1, 1988, and herein incorporated by reference.

In order to withstand high pressure without structural damage, the rails (22) are disposed in a cylindrical assembly including a pair of sidewall insulators (26) and sidewall supports (27). This cylindrical rail assembly is chilled in a low-temperature refrigerator and pressed into a hoop-wound fiberglass-epoxy tube (28) by using a hydraulic ram. In order to clamp the rail assembly components tightly together, a 4-piece bolt-together steel shell generally designated (29) is assembled around the fiberglass tube (28). The assembly procedure is further depicted in FIG. 2, and the design permits disassembly and testing of the various components.

After assembly as shown in FIG. 2, the end portions of the railgun are assembled onto the four clamping members of the compression frame (29). At the muzzle (25), there is provided and annular insulator (30) which is clamped to the insulating compression tube (28) and the rail assembly by a compression plate (31). Fastened to the compression plate (31) is a flash tube holder (32) holding a flash tube (33), as further described below in connection with FIG. 11. In a similar fashion, the breech (24) of the gun is closed off by a breech insulator (34) and a breech compression plate (35). Moreover, the breech end portion of the bore is sealed by a breech plug (36). The rails (22) and the breech plug (36) extend through a circular aperture in the breech insulator (34) to provide rail connections (37) to the power supply (21). For diagnostic purposes, a number of magnetic field probes (38) are disposed through the compression frame (20) and the compression tube (28) along the length of the rail assembly.

According to an important feature of the present invention, the geometry of the rail assembly permits rail movement without allowing insulator intrusion into the bore. As illustrated by the prior art geometry of FIG. 3, during firing magnetic pressure acts to drive rails (22') apart, causing them to exert force upon a fiber wound tube (28'). The tube (28') becomes deformed, as exaggerated in FIG. 3. The deformation of the tube (28') causes side wall insulators (26') to intrude into the bore and impede the path of the projectile (41). Therefore, the intrusion of the insulators (26') into the bore during firing may trap the projectile (41) thus spoiling the performance and possibly damaging the gun.

Figure 4:
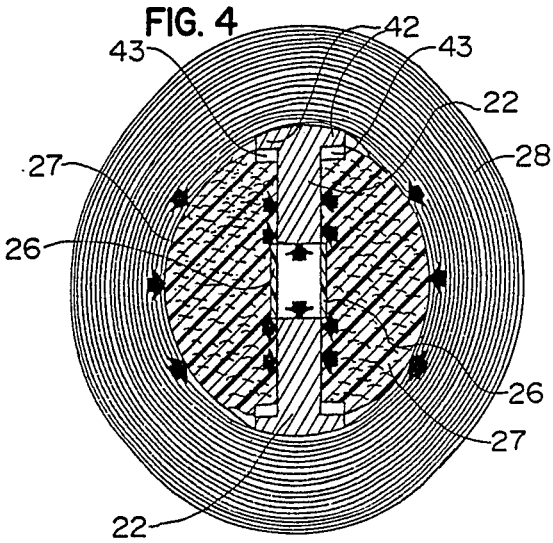
FIG. 4 is an illustration of how the preferred rail geometry prevents a low velocity projectile from being squeezed in the bore as the rails deflect during firing.

As shown in FIG. 4, the railgun of the present invention has a rail assembly geometry which permits rail movement without allowing insulator intrusion into the bore. As the rails (22) are forced apart by magnetic pressure and deform the fiber-wound tube (28), the tube exerts compressive forces on the sidewall supports (27). The sidewall supports (27) are compressed, but they bear against the rails (22) and therefore insulator intrusion is prevented. This rail assembly geometry also seals against plasma leakage because the sidewall support is forced into contact with the rails (22) when the magnetic pressure is greatest. Furthermore, when this sealing occurs, outwardly radial movement of the rails (22) is permitted. The resultant shearing action on the seal does not compromise the sealing action.

A further advantage of the rail assembly of FIG. 4 is that the insulator inserts (26) are isolated from rebound shocks, and therefore the insulator inserts (26) may be formed of brittle insulating materials such as fused quartz or float glass. In order to prevent intrusion of the rails (22) into the bore during rebound, the rails are formed with flanges (42) which butt against recessed stops (43) formed in the sidewall supports (27). To prevent the shock of the flanges (42) bouncing against the stops (43) from reaching the insulator inserts, the sidewall supports (27) are made of a durable, high modulus insulating material such as G-10 fiberglass epoxy.

Figure 5:
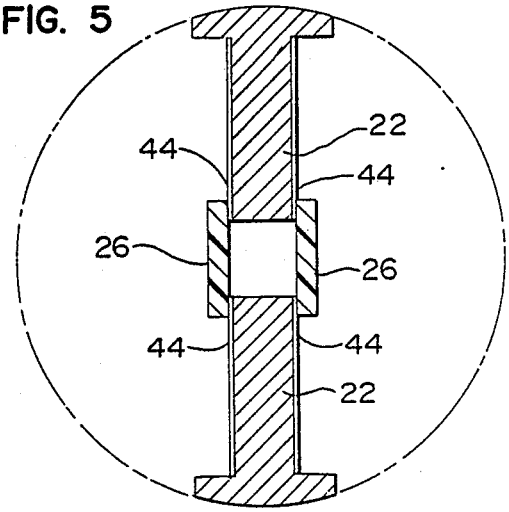
FIG. 5 is a cross-section showing in further detail the mounting of insulator inserts so that the inserts are easily changed and material testing is facilitated.

The sealing of the sidewall supports (27) and insulator inserts (26) with the rails (22) is further illustrated in FIG. 5. To confine the plasma armature behind the projectile, gaskets or sealing strips (44) are disposed between the insulating inserts (26) or sidewall suppports and the rails (22). The sealing strips are about 5–8 mils thick, and are, for example, Scotch brand double-sided adhesive masking tape from 3M Corporation, or lead foil strips. As the rails deflect as shown in FIG. 4, the rail-to-insulator seam tends to shear rather than separate, and the rail-to-insulator sealing strips or gaskets (44) remain compressed. The rails slide on the insulator, which helps to prevent rebound damage. It should be noted, however, that railgun structural stiffness is critical only in the low-velocity section of the gun near the breech. At high velocities, greater than about 2–4 km/s, the projectile runs in an undisturbed bore, outracing structural disturbances originating behind it.

The rail assembly geometry of FIG. 5 achieves good mechanical performance without appreciably sacrificing inductance and which exploits the relaxed stiffness requirements in the high-velocity section of the gun. A large rail cross-section is preferably used. This cross-section is much larger than needed for current duty and has the undesirable effect of lowering the inductance. But the rail assembly geometry serves several mechanical purposes: the rails are rigidly clamped in place, the rails resist bending, and the insulator inserts are better isolated from rebound shocks.

It is believed that the level of damage sustained by the insulators and the rails may depend on the quality of the rail-to-insulator seal and the bore-to-projectile seal. The reasoning is that if the quality of the seals is poor, material is lost from the armature or projectile. The armature demands more material to replenish itself, and this material is obtained by ablation from the rails and insulators.

The railgun was tested using four different kinds of materials for the insulator inserts. These four insulator materials included fused quartz, G-7 fiberglass laminate, polycarbonate and float glass. These materials are listed in decreasing order of ability to withstand ablation. The peak current in the 13 mm square bore varied from 500 to 560 kA. Of the materials tested, fused quartz and G-7 showed the most promise of being reusable at the high current densities of the tests.

To the eye, fused quartz showed no effects of ablation. It may be that the transparency of fused quartz is a factor in limiting ablation damage, along with its high melting point.

Post-shot inspection revealed that in places, the fused quartz did not break, but in other places it did break. The fact that some regions of the quartz were able to survive the high-pressure shot without breaking is encouraging. Quartz breakage appears to be sensitive to bore precision and to the precision with which the projectile is fit to the bore; an oversized projectile appears to result in increased quartz breakage.

Figure 6:
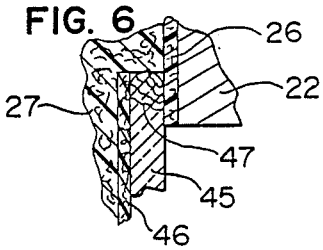
FIG. 6 is a cross-sectional view showing in greater detail the interface between a portion of an insulator insert and a portion of a rail at the corner of the square-bore.

The mounting of a 1×20 mm quartz ribbon (45) is shown in FIG. 6. A thin strip of epoxy-impregnated fiberglass fabric (46) about 300 um thick was used to adhesively bond the quartz ribbon (45) to a pocket machined into the sidewall support (27). A sealing surface is maintained during curing by placing the sidewall, insulator material down, on a piece of plate glass to cure, thus insuring that the sealing surface is continuous. For insulator replacement, the insulator is removed by chipping it out of the pocket.

When breakage of the quartz ribbon (45) occurs, it starts at the corner (47) of the bore where a step is produced by honing. If honing at the corner (47) does not occur and if the outer surface of the quartz strip is polished flat, it is expected that the breakage of the quartz might be eliminated.

Figure 7:
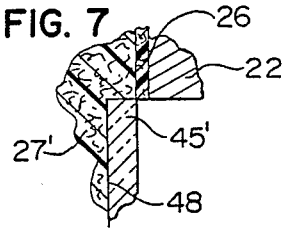
FIG. 7 is an alternative cross-sectional view corresponding to FIG. 6 but which might eliminate breakage of a brittle insulator insert.

Shown in FIG. 7 is a design which might eliminate breakage altogether. A sidewall support (27') is used consisting of a high-modulas material such as an alumina fiber ceramic composite. A quartz strip (45') of decreased width is used so as to eliminate overlap between the quartz strip and the rail (22). An adhesive joint (48) between the quartz strip (45') and the sidewall support (27') is used having a minimal thickness, for example less than about 50 μm.

Although the best results were obtained using a fused quartz insulator insert, G-7 grade laminated fiberglass also showed promise for being reusable. The G-7 fiberglass resisted ablation, but it was difficult to hone. The matrix material tended to powder under the hone, and the lamination boundaries were troublesome, but the results justify further testing, possibly with chopped fiber reinforcing rather than laminated fabric.

Polycarbonate was also used as an insulator insert. It was found that polycarbonate was easy to hone, but suffered visible ablation damage at the high current levels.

Float glass was also tested as insulator insert material. Not surprisingly, the glass shattered during firing. But the shattering of the glass did not affect the railgun performance; glass-insulated railguns would perform well on a one-shot basis. The glass is easily honed to very precise dimensions.

An interesting effect was observed with glass which was not observed with other materials. When firing the railgun, a metal fuse disposed in the breech of the gun behind the projectile is blown. After firing, it was found that the glass was covered with a thin, metal film having an appearance related to the composition of the fuse. When a copper fuse was used, the metal film was copper-colored. With an aluminum fuse, the metal film was grey in color, but the film may change to coppery colored for a short distance, then back to grey. Under the microscope, the metal film was found to be composed of metal spheres 1–10 μm in diameter 10–20 μm apart. With the copper fuse, the metal spheres appeared to have melted craters into the glass. With the aluminum fuse, no craters were observed.

As noted above, it is believed that a high-precision bore dramatically enhances performance by insuring a good plasma seal between the bore and the projectile. Preferably a high-precision railgun bore is produced by finishing the bore after the components have been assembled. Attempting to produce an accurate bore by assembling the gun from extremely precise components appears impractical. The railgun bores were finished by honing because this process can be used with virtually any material and because very high precision and good surface finish can be achieved. With honing, railgun bores were produced that varied only 5 μm in size along the length of the gun. It is believed that this high degree of precision is necessary for sustaining full projectile acceleration above 3 or 4 km/s.

Figure 8:
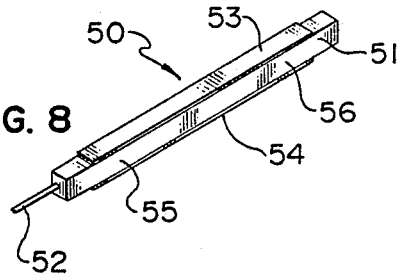
FIG. 8 is a pictorial view of a hone especially suited for honing a square-bore railgun having a small bore of about 10 mm or less.
Figure 9:
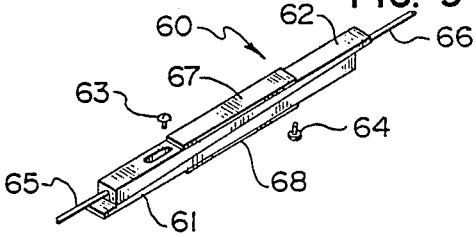
FIG. 9 is a pictorial view of an adjustable hone for a square-bore railgun.

Hone designs are illustrated in FIGS. 8 and 9. The important features of a well-designed hone are that the abrasive surfaces be accurately parallel, that fine thickness adjustments can be conveniently made, and that the hone be rigid. One is tempted to spring-load the abrasive, and thereby eliminate the need for a precise fit to the bore. A spring-loaded hone will, however, tend to follow the existing contours of the bore and will not produce precisely parallel bore surfaces as required.

Shown in FIG. 8 is a simple hone generally designated (50) which is not adjustable; therefore, a large set of such hones having incrementally increasing dimensions (in steps of 10 μm or less) is required. The hone (50) is especially suited for small-bore railguns having a bore of 10 mm or less. The hone includes a square stock (51) secured to a pushrod (52) and carrying abrasive sheets (53 and 54). The abrasive sheets, such as emery cloth or diamond-coated shimstock is attached with double-sided tape or other adhesive. The hone (50) includes set screws (55, 56) which are adjusted to push the hone to one side or the other for honing corners in the bore.

An adjustable hone generally designated (60) is shown in FIG. 9. The hone (6) includes a pair of wedges (61, 62) which are adjustably secured together by screws (63, 64). Respective rods (65, 66) and abrasive strips (67, 68) are secured to the wedges (61, 62). The wedge angle is preferably 0.75°.

Figure 10:
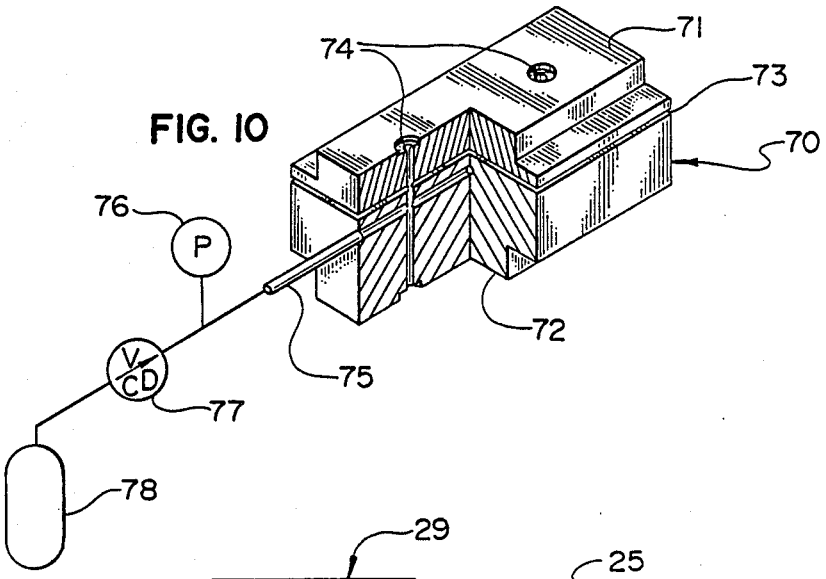
FIG. 10 is a schematic diagram illustrating the operation of a pneumatic gauge for precise measurement of the bore in a square-bore railgun.

Turning now to FIG. 10, there is shown a schematic diagram of a pneumatic gauge which is used to measure the bore thickness. The pneumatic gauge includes a gauge block generally designated (70) having precisely parallel faces (71, 72) which are spaced apart slightly less than the bore dimension to be measured. A shim (73) can be used to adjust the spacing so as to permit the measurement of various sizes of bores. The faces (71, 72) include orifices (74) which are pneumatically linked to a tube (75) externally coupled to a pressure gauge (76), a gas flow regulator (77), and a source of gas (78) such as a tank of compressed air or nitrogen. In order to indicate the gap between the faces (71, 72) of the gauge block (70) and a bore into which the gauge block is inserted, the flow regulator (77) supplies a constant flow of gas to the gauge block so that the pressure gauge (76) provides an indication inversely proportional to the gap width.

During testing, the railgun was fired inside a 400 mm diameter 8 m long vacuum chamber which was pumped down to less than $10^3$ Pa ($10^5$ Torr) for firing. Each time the gun was fired, a precursor arc struck in front of the projectile. This precursor, which drew about 50 kA, accelerated to the end of the 1-m gun in less than 20 μs.

Figure 11:
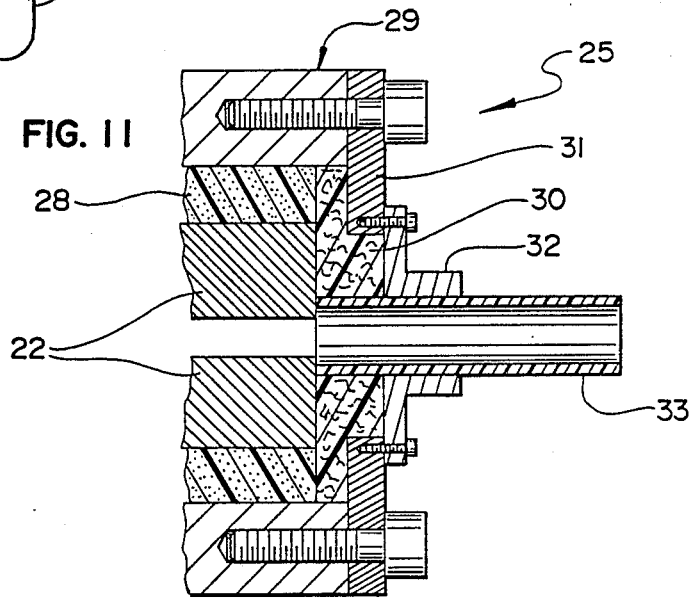
FIG. 11 is a cross-sectional view showing the mounting of a flash tube at the exit of the bore of the railgun of FIG. 1.

As shown in FIG. 11, the muzzle of the gun was equipped with the flash tube (33) in order to shield the steel compression frame (29) from the ends of the rails (22). Without the flash tube (33), a muzzle arc can reach from the rails to the steel compression frame, and thereby short the muzzle (25) of the gun. In this event, the current can commutate from the armature into the muzzle arc.

With the flash tube (33) in place, the current driving the muzzle arc gradually commutates (in about 200 μs) back into the armature, so that the muzzle arc is extinguished. Although the precursor carries about ten percent (10%) of the current, the effect on gun performance is believed to be negligible, because the precursor circuit acts like a closely coupled field turn. The flash tube, which was made of polycarbonate, was shattered by the muzzle blast on the more energetic shots. Possibly a flash tube wound of G-10 fiberglass may resist shattering. The flash tube does not eliminate precursor arcs, but it does prevent a precursor from affecting the performance of the gun. By using the flash tube (33), the adverse effect of the precursor can be eliminated without increasing the vacuum chamber pressure.

Figure 12:
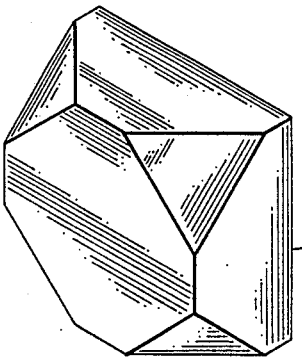
FIG. 12 is a pictorial view of a lightened projectile which is preferably used with the square-bore railgun of FIG. 1.

In order to fire projectiles to a final velocity of about 5 km/s, the projectiles (23) were fashioned from polycarbonate to have the shape shown in FIG. 12. The length to diameter ratio was as small as 0.65, and by removing the corners the mass of the projectile was decreased by about 11% without any apparent adverse effect.

In view of the above, a high performance railgun has been disclosed which is capable of high-pressure operation without structural damage and which is readily disassembled for inspection, maintenance and component testing. Very high projectile acceleration and terminal velocities have been achieved. The geometry of the rail assembly permits the use of a rigid insulator insert which can be made of fused quartz for multiple-shot operation. The rail assembly geometry also insures good sealing of the rail-to-insulator seams to prevent loss of plasma and also prevents insulator intrusion into the bore. The performance of the railgun is further improved by the use of a flash tube for suppressing precursor discharge and by using a projectile geometry which minimizes projectile mass while maintaining a precise fit between the projectile and the bore.

What is claimed is:

1. An electromagnetic railgun having a pair of parallel spaced electrically conductive projectile launching rails and an insulating structure supporting said rails and cooperating with said rails to form a bore between said rails, wherein said insulating structure comprises a pair of spaced-apart insulators on opposite sides of the bore, an insulating containment tube receiving the spaced apart insulators and the rails, and a compression frame receiving the containment tube and including means for clamping the containment tube so as to exert a compressive force engaging the rails with the insulating structure, wherein said insulating structure includes sidewall supports and said rails include flanges adjacent the containment tube which abut against stops formed in the sidewall supports.

2. The electromagnetic railgun as claimed in claim 1, wherein said sidewall supports have pockets defined therein, and the insulators are mounted in said pockets.

3. The electromagnetic railgun as claimed in claim 2, wherein the insulators are strips of fused quartz.

4. An electromagnetic railgun having a pair of parallel spaced electrically conductive projectile launching rails and insulating structure supporting said rails and cooperating with said rails to form a bore between said rails, wherein said insulating structure comprises a pair of spaced-apart insulators on opposite sides of the bore, an insulating containment tube receiving the spaced apart insulators and the rails, and a compression frame receiving the containment tube and including means for clamping the containment tube so as to exert a compressive force engaging the rails with the insulating structure, further comprising gaskets disposed between the rails and said insulating structure, wherein said gaskets are in the form of thin, flat elongated strips extending parallel to the rails.

5. An electromagnetic railgun having a pair of parallel spaced electrically conductive projectile launching rails, a pair of spaced-apart sidewall supports on opposite sides of the bore, and a containment structure receiving the spaced-apart sidewall supports and the rails, wherein a pair of spaced-apart insulators on opposite sides of the bore are supported by respective ones of the sidewall supports, and the rails have flanges adjacent the containment structure which abut against stops formed in the sidewall supports, so that when the rails are driven apart by electromagnetic forces and rebound from the containment structure, the flanges of the rails impact against the stops in the sidewall supports and the sidewall supports thereby isolate the insulators form direct impact with the rails.

6. The electromagnetic railgun as claimed in claim 5, wherein the containment structure comprises an insulating containment tube and a compression frame receiving the containment tube; the insulating containment tube receives the spaced-apart sidewall supports, the spaced-apart insulators and the rails; and the compression frame includes means for clamping the containment tube so as to exert a compressive force engaging the rails with the sidewall supports.

7. The electromagnetic railgun as claimed in claim 5, wherein the insulators are strips of fused quartz.

8. The electromagnetic railgun as claimed in claim 5, further comprising shear gaskets in the form of thin, flat and elongated strips extending parallel to the rails and disposed between the rails and the sidewall supports.

9. The electromagnetic railgun as claimed in claim 5, wherein the space between the rails is defined by the rails and the insulators to have a square cross-section.

* * * * *

UNITED STATES PATENT AND TRADEMARK OFFICE

CERTIFICATE OF CORRECTION

PATENT NO. : 4,884,489

DATED : December 05,1989

INVENTOR(S) : Raymond C. Zowarka, et al

It is certified that error appears in the above-identified patent and that said Letters Patent is hereby corrected as shown below:

Col. 1, Line 46, please change "By" to --by--.

Col. 8, Line 57, please change "$^{3}$" to --$^{-3}$--.

Col. 8, Ln. 57, please change "$^{5}$" to --$^{-5}$--.

Col. 10, Line 34, please change "form" to --from--.

Signed and Sealed this

Eighteenth Day of December, 1990

*Attest:*

HARRY F. MANBECK, JR.

*Attesting Officer*

*Commissioner of Patents and Trademarks*